US009069308B2

(12) United States Patent
Qi et al.

(10) Patent No.: US 9,069,308 B2
(45) Date of Patent: Jun. 30, 2015

(54) SURFACE COATING AND FUSER MEMBER

(71) Applicant: Xerox Corporation, Norwalk, CT (US)

(72) Inventors: Yu Qi, Oakville (CA); Nan-Xing Hu, Oakville (CA); Brynn M. Dooley, Toronto (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 201 days.

(21) Appl. No.: 13/870,432

(22) Filed: Apr. 25, 2013

(65) Prior Publication Data

US 2014/0321893 A1 Oct. 30, 2014

(51) Int. Cl.
*G03G 15/20* (2006.01)

(52) U.S. Cl.
CPC ..... *G03G 15/2057* (2013.01); *Y10T 428/1362* (2013.01); *Y10T 428/1393* (2013.01)

(58) Field of Classification Search
CPC .... B32B 1/08; G03G 15/2057; G03G 15/206; Y10T 428/1362; Y10T 428/1393
USPC ..... 428/36.1–36.5, 36.91; 399/333
See application file for complete search history.

(56) References Cited

PUBLICATIONS

Wang et al., "Durable, self-healing superhydrophobic and superoleophobic surfaces from fluorinated-decyl polyhedral oligomeric silsesquioxane and hydrolyzed fluorinated alkyl silane," Angew Chem Int Ed. 50(48):11433-6 (2011).

*Primary Examiner* — Walter B Aughenbaugh
(74) *Attorney, Agent, or Firm* — Hoffman Warnick LLC

(57) ABSTRACT

There is described a fuser member comprising a substrate layer and a surface layer disposed on the substrate. The surface layer comprises a non-woven polymer fiber matrix having dispersed throughout a cross-linked fluoropolymer and a release agent. The release agent is a liquid at a temperature about 100° C.

20 Claims, 4 Drawing Sheets

SURFACE COATING AND FUSER MEMBER

CROSS REFERENCE TO RELATED APPLICATIONS

This application relates to commonly assigned copending application Ser. No. 13/870,437 entitled "Surface Coating and Fuser Member."

BACKGROUND

1. Field of Use

This disclosure is generally directed to surface layers for fuser members useful in electrophotographic imaging apparatuses, including digital, image on image, and the like.

2. Background

Fluoroplastics such as polytetrafluoroethylene (PTFE, e.g. Teflon®) or perfluoroalkyl resin (PFA) are currently used as fuser topcoat materials for oil-less fusing. Fluoroplastics are mechanically rigid and are easily damaged. In addition, fluoroplastics are difficult to process due to their high melting temperatures (>300° C.) and insolubility in a variety of solvents. The high baking temperature often causes surface defects during fabrication as the under coat layer degrades at the high melting temperatures. There is a need to develop a fuser topcoat material that can be easily processed and cured at low temperatures (i.e., <260° C.) while maintaining sustained toner release performance.

A coating having a low surface energy that is durable and easily manufactured is desirable.

SUMMARY

According to an embodiment, there is described a fuser member including a substrate layer and a surface layer disposed on the substrate. The surface layer comprises a non-woven polymer fiber matrix having dispersed throughout a cross-linked fluoropolymer and a release agent. The release agent is a liquid at a temperature about 100° C.

According to another embodiment, there is provided a fuser member including a substrate, an intermediate layer disposed on the substrate, and a surface layer disposed on the intermediate layer. The surface layer includes a non-woven polymer fiber matrix having dispersed throughout a cross-linked fluoropolymer and a release agent. The cross-linked fluoropolymer is from about 10 weight percent to about 95 weight percent of the surface layer. The release agent is a liquid at a temperature about 100° C. The release agent comprises from about 1 weight percent to about 50 weight percent of the surface layer.

According to another embodiment, there is provided a fuser member having a substrate, a silicone layer disposed on the substrate; and a surface layer disposed on the silicone layer. The surface layer includes a non-woven polyimide fiber matrix having dispersed throughout a cross-linked perfluoropolyether and a liquid perfluoropolyether release agent. The polyimide fibers have a diameter of from about 5 nm to about 50 μm.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
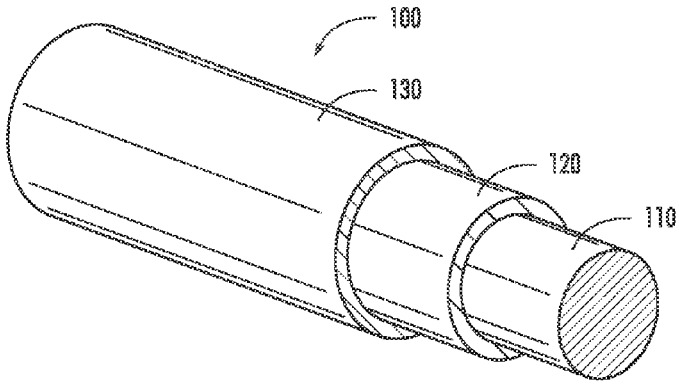
FIG. 1 depicts an exemplary fusing member having a cylindrical substrate in accordance with the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Disclosed herein is a surface layer having a non-woven polymer fiber matrix having dispersed through cross-linked fluoropolymer and a release agent which is a liquid at a temperature above 100° C. In U.S. Ser. No. 13/040,568 filed on Mar. 4, 2011 and incorporated in its entirety by reference herein, a fuser sleeve is described. The fuser sleeve is a fluoropolymer dispersed in a plurality of non-woven polymer fibers wherein the polymer fibers have a diameter of from about 5 nm to about 50 μm. The fluoropolymer described in U.S. Ser. No. 13/040,568 requires high temperature processing.

Polyimide membranes comprising a mat of non-woven polyimide fibers having a fluoropolymer sheath are described in U.S. Ser. No. 13/444,366 filed on Apr. 11, 2012 and incorporated in its entirety by reference herein.

As used herein, the term "hydrophobic/hydrophobicity" and the term "oleophobic/oleophobicity" refer to the wettability behavior of a surface that has, e.g., a water and hexadecane (or hydrocarbons, silicone oils, etc.) contact angle of approximately 90° or more, respectively. For example, on a hydrophobic/oleophobic surface, a ~10-15 μL water/hexadecane drop can bead up and have an equilibrium contact angle of approximately 90° or greater.

As used herein, the term "ultrahydrophobicity/ultrahydrophobic surface" and the term "ultraoleophobic/ultraoleophobicity" refer to wettability of a surface that has a more restrictive type of hydrophobicity and oleophobicity, respectively. For example, the ultrahydrophobic/ultraoleophobic surface can have a water/hexadecane contact angle of about 120° or greater.

The term "superhydrophobicity/superhydrophobic surface" and the term "superoleophobic/superoleophobicity" refer to wettability of a surface that has an even more restrictive type of hydrophobicity and oleophobicity, respectively. For example, a superhydrophobic/superoleophobic surface can have a water/hexadecane contact angle of approximately 150 degrees or greater and have a ~10-15 μL water/hexadecane drop roll freely on the surface tilted a few degrees from level. The sliding angle of the water/hexadecane drop on a superhydrophobic/superoleophobic surface can be about 10 degrees or less. On a tilted superhydrophobic/superoleophobic surface, since the contact angle of the receding surface is high and since the interface tendency of the uphill side of the drop to stick to the solid surface is low, gravity can overcome the resistance of the drop to slide on the surface. A superhydrophobic/superoleophobic surface can be described as having a very low hysteresis between advancing and receding contact angles (e.g., 40 degrees or less). Note that larger drops can be more affected by gravity and can tend to slide easier, whereas smaller drops can tend to be more likely to remain stationary or in place.

As used herein, the term "low surface energy" and the term "very low surface energy" refer to ability of molecules to adhere to a surface. The lower the surface energy, the less likely a molecule will adhere to the surface. For example, the low surface energy is characterized by a value of about 20 mN/m or less, very low surface energy is characterized by a value of about 10 mN/m or less.

In various embodiments, the fixing member can include, for example, a substrate, with one or more functional layers formed thereon. The substrate can be formed in various shapes, e.g., a cylinder (e.g., a cylinder tube), a cylindrical drum, a belt, or a film, using suitable materials that are non-conductive or conductive depending on a specific configuration, for example, as shown in FIGS. 1 and 2.

Figure 2:
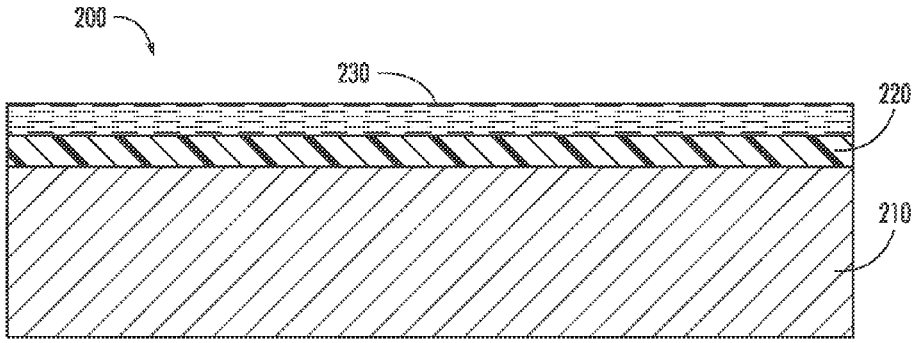
FIG. 2 depicts an exemplary fusing member having a belt substrate in accordance with the present teachings.

Specifically, FIG. 1 depicts an exemplary fixing or fusing member 100 having a cylindrical substrate 110 and FIG. 2 depicts in cross-section another exemplary fixing or fusing member 200 having a belt substrate 210 in accordance with the present teachings. It should be readily apparent to one of ordinary skill in the art that the fixing or fusing member 100 depicted in FIG. 1 and the fixing or fusing member 200 depicted in FIG. 2 represent generalized schematic illustrations and that other layers/substrates can be added or existing layers/substrates can be removed or modified.

In FIG. 1 the exemplary fixing member 100 can be a fuser roller having a cylindrical substrate 110 with one or more functional layers 120 (also referred to as intermediate layers) and a surface layer 130 formed thereon. In various embodiments, the cylindrical substrate 110 can take the form of a cylindrical tube, e.g., having a hollow structure including a heating lamp therein, or a solid cylindrical shaft. In FIG. 2, the exemplary fixing member 200 can include a belt substrate 210 with one or more functional layers, e.g., 220 and an outer surface 230 formed thereon.

Substrate Layer

The belt substrate 210 (FIG. 2) and the cylindrical substrate 110 (FIG. 1) can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes) and metal materials (e.g., aluminum or stainless steel) to maintain rigidity and structural integrity as known to one of ordinary skill in the art.

Intermediate Layer

Examples of intermediate or functional layers 120 (FIG. 1) and 220 (FIG. 2) include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Examples of intermediate or functional layers 120 (FIG. 1) and 220 (FIG. 2) also include fluoroelastomers. Fluoroelastomers are from the class of 1) copolymers of two of vinylidenefluoride, hexafluoropropylene, and tetrafluoroethylene; such as those known commercially as VITON A®, 2) terpolymers of vinylidenefluoride, hexafluoropropylene, and tetrafluoroethylene such as those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS® TH® NH®, P757® TNS®, T439 ®, PL958® BR9151® and TN505®, available from Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer. Cure site monomers are available from Dupont.

For a roller configuration, the thickness of the intermediate or functional layer can be from about 0.5 mm to about 10 mm, or from about 1 mm to about 8 mm, or from about 2 mm to about 7 mm. For a belt configuration, the functional layer can be from about 25 microns up to about 2 mm, or from 40 microns to about 1.5 mm, or from 50 microns to about 1 mm.

Surface Layer or Release Layer

Disclosed herein is self-release fuser topcoat comprising a non-woven polymer fiber matrix having a cross-linked fluoropolymer mixed with a release agent compatible with the cross-linked fluoropolymer. The release agent is a liquid at a temperature of greater than 100° C. The non-woven polymer fiber matrix provides the mechanical robustness, surface texture, and the host for the self-release and self-healing composition of the cross-linked fluoropolymer and the release agent which is a liquid at a temperature of greater than 100° C.

In an embodiment there is described a self-release fuser topcoat comprising a non-woven polymer fiber matrix having a cross-linked perfluoropolyether mixed with an internal release agent such as perfluoropolyether (PFPE). In an embodiment, a fuser topcoat is made with a high performance polyimide network filled with a composition dispersed throughout containing a crosslinked perfluorpolyether and a perfluorpolyether release agent. The non-woven polymer fiber matrix provides the mechanical robustness, surface texture, and the host for the self-release composition.

Additives and additional conductive or non-conductive fillers may be present in the substrate layers 110 and 210, the intermediate layers 220 and 230 and the release layers 130 and 230. In various embodiments, other filler materials or additives including, for example, inorganic particles, can be used for the coating composition and the subsequently formed surface layer. Conductive fillers used herein may include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly (p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

Adhesive Layer

Optionally, any known and available suitable adhesive layer may be positioned between the outer layer or surface layer and the intermediate layer or between the intermediate layer and the substrate layer. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. The adhesive layer can be coated on the substrate, or on the outer layer, to a thickness of from about 2 nanometers to about 10,000 nanometers, or from about 2 nanometers to about 1,000 nanometers, or from about 2 nanometers to about 5000 nanometers. The adhesive can be coated by any suitable known technique, including spray coating or wiping.

Figure 3A:
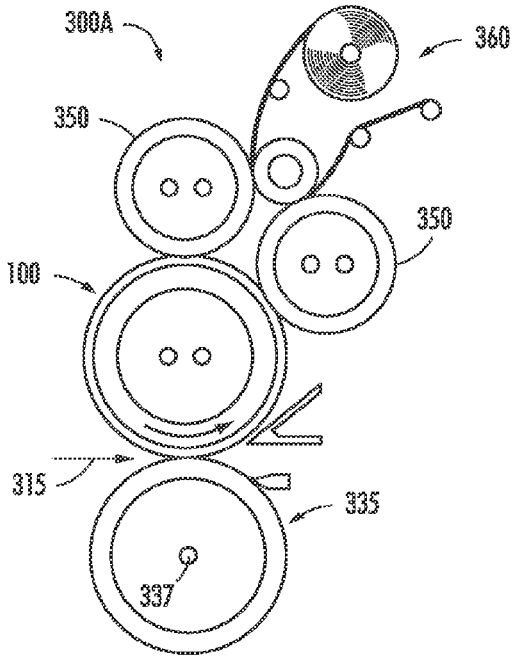
FIGS. 3A-3B depict exemplary fusing configurations using the fuser rollers shown in FIG. 1 in accordance with the present teachings.
Figure 3B:
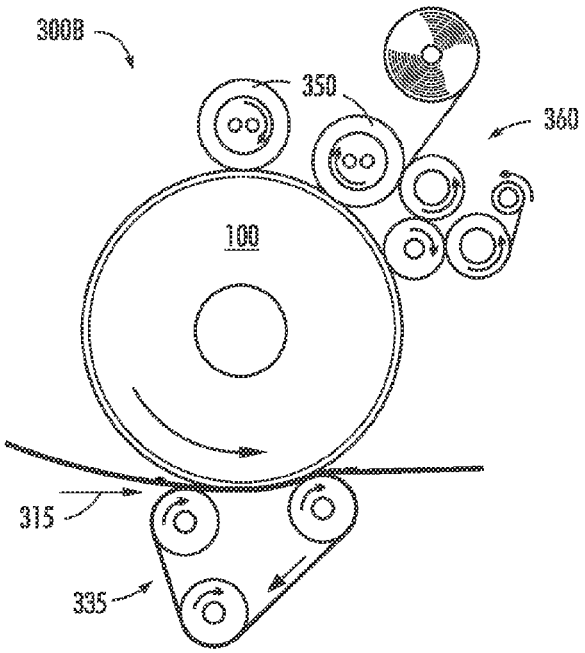
Figure 4A:
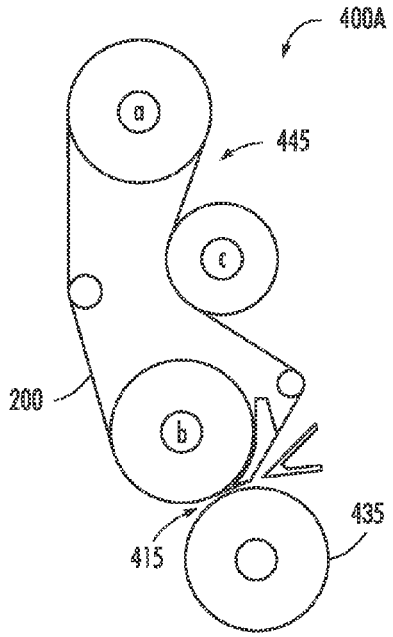
FIGS. 4A-4B depict another exemplary fusing configuration using the fuser belt shown in FIG. 2 in accordance with the present teachings.
Figure 4B:
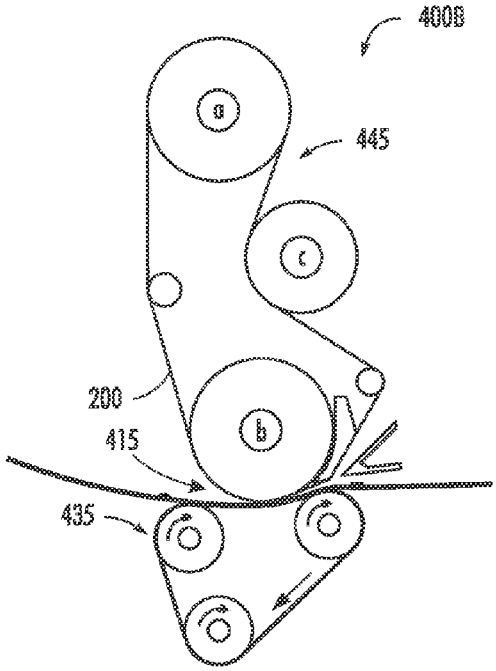

FIGS. 3A-3B and FIGS. 4A-4B depict exemplary fusing configurations for the fusing process in accordance with the present teachings. It should be readily apparent to one of ordinary skill in the art that the fusing configurations 300A-B depicted in FIGS. 3A-3B and the fusing configurations 400A-B depicted in FIGS. 4A-4B represent generalized schematic illustrations and that other members/layers/substrates/configurations can be added or existing members/layers/substrates/configurations can be removed or modified. Although an electrophotographic printer is described herein, the disclosed apparatus and method can be applied to other printing technologies. Examples include offset printing and inkjet and solid transfix machines.

FIGS. 3A-3B depict the fusing configurations 300A-B using a fuser roller shown in FIG. 1 in accordance with the present teachings. The configurations 300A-B can include a fuser roller 100 (i.e., 100 of FIG. 1) that forms a fuser nip with a pressure applying mechanism 335, such as a pressure roller in FIG. 3A or a pressure belt in FIG. 3B, for an image supporting material 315. In various embodiments, the pressure applying mechanism 335 can be used in combination with a heat lamp 337 to provide both the pressure and heat for the fusing process of the toner particles on the image supporting material 315. In addition, the configurations 300A-B can include one or more external heat roller 350 along with, e.g., a cleaning web 360, as shown in FIG. 3A and FIG. 3B.

FIGS. 4A-4B depict fusing configurations 400A-B using a fuser belt shown in FIG. 2 in accordance with the present teachings. The configurations 400A-B can include a fuser belt 200 (i.e., 200 of FIG. 2) that forms a fuser nip with a pressure applying mechanism 435, such as a pressure roller in FIG. 4A or a pressure belt in FIG. 4B, for a media substrate 415. In various embodiments, the pressure applying mechanism 435 can be used in a combination with a heat lamp to provide both the pressure and heat for the fusing process of the toner particles on the media substrate 415. In addition, the configurations 400A-B can include a mechanical system 445 to move the fuser belt 200 and thus fusing the toner particles and forming images on the media substrate 415. The mechanical system 445 can include one or more rollers 445*a-c*, which can also be used as heat rollers when needed.

Figure 5:
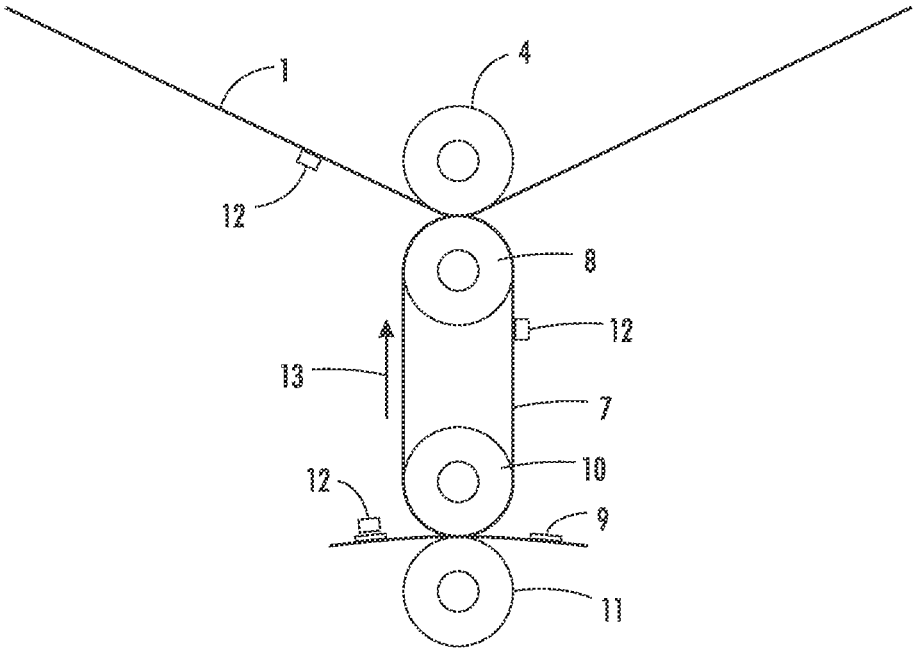
FIG. 5 depicts an exemplary fuser configuration using a transfix apparatus.

FIG. 5 demonstrates a view of an embodiment of a transfix member 7 which may be in the form of a belt, sheet, film, or like form. The transfix member 7 is constructed similarly to the fuser belt 200 described above. The developed image 12 positioned on intermediate transfer member 1 is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

The fuser surface layer or release layer includes a non-woven polymer fiber matrix having dispersed throughout a cross-linked fluoropolymer and a release agent which is a liquid at a temperature of greater than 100° C. The cross-linked fluoropolymer includes; copolymers of two of vinylidenefluoride, hexafluoropropylene, and tetrafluoroethylene; terpolymers of vinylidenefluoride, hexafluoropropylene, and tetrafluoroethylene; tetrapolymers of vinylidenefluoride, hexafluoropropylene, tetrafluoroethylene and a cure site monomer; and perfluoropolyether. The release agent includes perfluoropolyether; polysiloxanes, for examples silicone oil; fluorinated polysiloxanes; fluorinated silanes; and polyhedral oligomeric silsesquioxanes (POSS). The amount of cross-linked fluoropolymer in the release layer containing the non-woven polymer fiber matrix ranges from about 10 weight percent to about 95 weight percent, or in embodiments from about 20 weight percent to about 90 weight percent or from about 50 weight percent to about 80 weight percent. The amount of the release agent which is a liquid at a temperature of greater than 100° C. in the release layer containing the non-woven polymer fiber matrix ranges from about 1 weight percent to about 50 weight percent, or from about 5 weight percent to about 40 weight percent or from about 10 weight percent to about 20 weight percent. The thickness of the release layer ranges from about 10 μm to about 400 μm, or from about 20 μm to about 300 μm, or from about 25 μm to about 200 μm.

In an embodiment, a fuser topcoat is made with a high performance polyimide network filled with a self-releasing composition containing a cross-linked perfluoropolyether mixed with an internal release agent of perfluoropolyether (PFPE). In this design, the polyimide network provides the framework for the mechanical robustness, surface texture, and the host for the self-release composition, while the cross-linked PFPE provides a low energy surface and the release agent enhances performance. The release agent is a liquid at a temperature of greater than 100° C. and is therefore able to migrate to damaged areas of the surface layer to maintain performance and actually heal the damage to the surface.

Nonwoven fabrics are broadly defined as sheet or web structures bonded together by entangling fiber or filaments (and by perforating films) mechanically, thermally or chemically. They include flat, porous sheets that are made directly from separate fibers or from molten plastic or plastic film. They are not made by weaving or knitting and do not require converting the fibers to yarn. Compared to the conventional non-woven fabrics, the fabrics described herein have the advantages of high surface area for strong interaction between the fabrics and the filler polymer, high loading in the composite coating (>50%), uniform, well-controlled morphology and very low surface energy.

The fuser surface layer includes a non-woven matrix of polymer fibers. In embodiments, the polymer fibers are surrounded by a coating or sheath of a fluoropolymer. A cross-linked polymer and release agent are dispersed throughout the non-woven matrix. In an embodiment, the release layer includes two distinct layers, a surface layer of the cross-linked polymer and release agent which is supported on a non-woven matrix of polymer fibers wherein the cross-linked polymer and release agent are dispersed throughout the non-woven matrix. The polymer fibers can be surrounded by a coating or sheath of a fluoropolymer in such a configuration.

Nonwoven fabrics are broadly defined as sheet or web structures bonded together by entangling fiber or filaments (and by perforating films) mechanically, thermally or chemically. They include flat, porous sheets that are made directly from separate fibers or from molten plastic or plastic film. They are not made by weaving or knitting and do not require converting the fibers to yarn. Compared to the conventional non-woven fabrics, the fabrics described herein have the advantages of high surface area for strong interaction between the fabrics and the filler polymer, high loading in the composite coating (>50%), uniform, well-controlled morphology and very low surface energy.

The fuser topcoat is fabricated by applying the polymer fibers onto a substrate by an electrospinning process. Electrospinning uses an electrical charge to draw very fine (typically on the micro or nano scale) fibers from a liquid. The charge is provided by a voltage source. The process does not require the use of coagulation chemistry or high temperatures to produce solid threads from solution. This makes the process particularly suited to the production of fibers using large and complex molecules such as polymers. When a sufficiently high voltage is applied to a liquid droplet, the body of the liquid becomes charged, and electrostatic repulsion counteracts the surface tension and the droplet is stretched. At a critical point a stream of liquid erupts from the surface. This point of eruption is known as the Taylor cone. If the molecular cohesion of the liquid is sufficiently high, stream breakup does not occur and a charged liquid jet is formed.

Electrospinning provides a simple and versatile method for generating ultrathin fibers from a rich variety of materials that include polymers, composites and ceramics. To date, numerous polymers with a range of functionalities have been electospun as nanofibers. In electrospinning, a solid fiber is generated as the electrified jet (composed of a highly viscous polymer solution with a viscosity range of from about 1 to about 400 centipoises, or from about 5 to about 300 centipoises, or from about 10 to about 250 centipoises) is continuously stretched due to the electrostatic repulsions between the surface charges and the evaporation of solvent. Suitable solvents include dimethylformamide, dimethylacetamide, 1-Methyl-2-pyrrolidone, tetrahydrofuran, a ketone such as acetone, methylethylketone, dichloromethane, an alcohol such as ethanol, isopropyl alcohol, water and mixtures thereof. The weight percent of the polymer in the solution ranges from about 1 percent to about 60 percent, or from about 5 percent to about 55 percent to from about 10 percent to about 50 percent.

Exemplary materials used for the electrospun fiber with or without a fluoropolymer sheath can include: polyamide such as aliphatic and/or aromatic polyamide, polyester, polyimide, fluorinated polyimide, polycarbonate, polyurethane, polyether, polyoxadazole, polybenzimidazole, polyacrylonitrile, polycaprolactone, polyethylene, polypropylenes, acrylonitrile butadiene styrene (ABS), polybutadiene, polystyrene, polymethyl-methacrylate (PMMA), poly(vinyl alcohol), poly(ethylene oxide), polylactide, poly(caprolactone), poly (ether imide), poly(ether urethane), poly(arylene ether), poly (arylene ether ketone), poly(ester urethane), poly(p-phenylene terephthalate), cellulose acetate, poly(vinyl acetate), poly(acrylic acid), polyacrylamide, polyvinylpyrrolidone, hydroxypropylcellulose, poly(vinyl butyral), poly(alkly acrylate), poly(alkyl methacrylate), polyhydroxybutyrate, fluoropolymer, poly(vinylidene fluoride), poly(vinylidene fluoride-co-hexafluoropropylene), fluorinated ethylene-propylene copolymer, poly(tetrafluoroethylene-co-perfluoropropyl vinyl ether), poly((perfluoroalkyl)ethyl methacrylate), cellulose, chitosan, gelatin, protein, and mixtures thereof. In embodiments, the electrospun fibers can be formed of a tough polymer such as Nylon, polyimide, and/or other tough polymers.

Exemplary materials used for the electrospun fibers when there is no sheath or coating include fluoropolymers selected from the group consisting of: copolymers of vinylidenefluoride, hexafluoropropylene and tetrafluoropropylene and tetrafluoroethylene; terpolymers of vinylidenefluoride, hexafluoropropylene and tetrafluoroethylene; tetrapolymers of vinylidenefluoride, hexafluoropropylene, tetrafluoroethylene, and a cure site monomer; polytetrafluoroethylene (PTFE); perfluoroalkoxy polymer resin (PFA); copolymers of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP) and a cure site monomer.

In embodiments, fluorinated polyimides (FPI) are used for the core with or without a sheath of the polymers in the non-woven matrix layer. Fluorinated polyimides are synthesized in high molecular weight using a known procedure as shown in Equation 1.

Equation 1

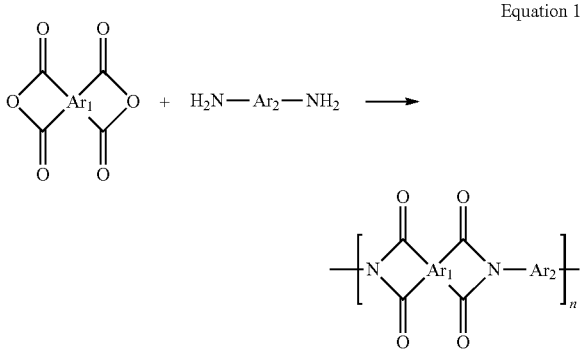

wherein one of wherein $Ar_1$ and $Ar_2$ independently represent an aromatic group of from about 4 carbon atoms to about 60 carbon atoms; and at least one of $Ar_1$ and $Ar_2$ further contains fluorine. In the polyimide above, n is from about 30 to about 500, or from about 40 to about 450 or from about 50 to about 400.

More specific examples of fluorinated polyimides include the following general formula:

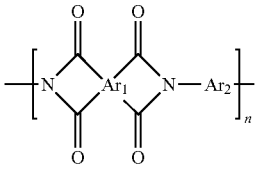

wherein $Ar_1$ and $Ar_2$ independently represent an aromatic group of from about 4 carbon atoms to about 100 carbon atoms, or from about 5 to about 60 carbon atoms, or from about 6 to about 30 carbon atoms such as such as phenyl, naphthyl, perylenyl, thiophenyl, oxazolyl; and at least one of $Ar_1$ and $Ar_2$ further contains a fluoro-pendant group. In the polyimide above, n is from about 30 to about 500, or from about 40 to about 450 or from about 50 to about 400.

$Ar_1$ and $Ar_2$ can represent a fluoroalkyl having from about 4 carbon atoms to about 100 carbon atoms, or from about 5 carbon atoms to about 60 carbon atoms, or from about 6 to about 30 carbon atoms.

In embodiments, the electrospun fibers can have a diameter ranging from about 5 nm to about 50 μm, or ranging from about 50 nm to about 20 μm, or ranging from about 100 nm to about 1 μm. In embodiments, the electrospun fibers can have an aspect ratio about 100 or higher, e.g., ranging from about 100 to about 1,000, or ranging from about 100 to about 10,000, or ranging from about 100 to about 100,000. In embodiments, the non-woven fabrics can be non-woven nano-fabrics formed by electrospun nanofibers having at least one dimension, e.g., a width or diameter, of less than about 1000 nm, for example, ranging from about 5 nm to about 500 nm, or from 10 nm to about 100 nm. In embodiments, the non-woven fibers comprise from about 10 weight percent to about 50 weight percent of the release layer. In embodiments, the non-woven fibers comprise from about 15 weight percent to about 40 weight percent, or from about 20 percent to about 30 weight percent of the release layer.

In embodiments, the sheath on the polymer fibers is formed by coating the polymer fiber core with a fluoropolymer and heating the fluoropolymer. The fluoropolymers have a curing or melting temperature of from about 150° C. to about 360° C. or from about 280° C. to about 330° C. The thickness of the sheath can be from about 10 nm to about 200 microns, or from about 50 nm to about 100 microns or from about 200 nm to about 50 microns.

In an embodiment core-sheath polymer fiber can be prepared by co-axial electrospinning of polymer core and the fluoropolymer (such as Viton) to form the non-woven core-sheath polymer fiber layer.

Examples of fluoropolymers useful as the sheath or coating of the polymer fiber include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and a cure site monomer. These fluoroelastomers are known commercially under various designations such as VITON A®, VITON B® VITON E® VITON E 60C®, VITON E430®, VITON 910®, VITON GH®; VITON GF®; and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR®, FOR-LHF®, NM® FOR-THF®, FOR-TFS®, TH®, NH®, P757®, TNS®, T439®, PL958®, BR9151® and TN505®, available from Solvay Solexis.

Examples of three known fluoroelastomers are (1) a class of copolymers of two of vinylidenefluoride, hexafluoropropylene, and tetrafluoroethylene, such as those known commercially as VITON A®; (2) a class of terpolymers of vinylidenefluoride, hexafluoropropylene, and tetrafluoroethylene known commercially as VITON B®; and (3) a class of tetrapolymers of vinylidenefluoride, hexafluoropropylene, tetrafluoroethylene, and cure site monomer known commercially as VITON GH® or VITON GF®.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

Examples of fluoropolymers useful as the sheath or coating on the polymer fiber core include fluoroplastics. Fluoroplastics suitable for use herein include fluoropolymers comprising a monomeric repeat unit that is selected from the group consisting of vinylidene fluoride, hexafluoropropylene, tetrafluoroethylene, perfluoroalkylvinylether, and mixtures thereof. Examples of fluoroplastics include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof.

The fuser topcoat is fabricated by applying the polymer fibers onto the intermediate layer of a fuser substrate by an electrospinning process. Electrospinning uses an electrical charge to draw very fine (typically on the micro or nano scale) fibers from a liquid. The charge is provided by a voltage source. The process does not require the use of coagulation chemistry or high temperatures to produce solid threads from solution. This makes the process particularly suited to the production of fibers using large and complex molecules such as polymers. When a sufficiently high voltage is applied to a liquid droplet, the body of the liquid becomes charged, and electrostatic repulsion counteracts the surface tension and the droplet is stretched. At a critical point a stream of liquid erupts from the surface. This point of eruption is known as the Taylor cone. If the molecular cohesion of the liquid is sufficiently high, stream breakup does not occur and a charged liquid jet is formed.

After the non-woven polymer fibers are electrospun on an intermediate layer or substrate, a composition of cross-linked perfluoropolyether and perfluoropolyether release agent is flow coated onto the polymer fibers. The composition is cured at temperatures of from about 150° C. to about 200° C. to form a solid polymer throughout the non-woven polymer fibers.

In the literature report (Angew. Chem. Int. Ed. 2011, 50, 11433-11436), a super-liquid-repellent surface of self-release fabric coatings can be refurbished by thermal treatment even after plasma damage. The self-healing fabric coatings were produced with a hydrolysis product of fluorinated alkyl silane and fluorinated-decyl polyhedral oligomeric silsesquioxane interpenetrating into a woven fabric.

Suitable cross-linked fluoropolymers dispersed throughout and on top of the non-woven polymer fiber matrix include copolymers of two of; vinylidenefluoride, hexafluoropropylene, and tetrafluoroethylene; terpolymers of vinylidenefluoride, hexafluoropropylene, and tetrafluoroethylene; tetrapolymers of vinylidenefluoride, hexafluoropropylene, tetrafluoroethylene and a cure site monomer; and perfluoropolyether.

Suitable cross-linked fluoropolymers include the fluoropolymer listed previously for the core or sheath of the polymer fiber.

Suitable cross-linked fluoropolymers also include cross-linked perfluoropolyether is available from Shin-Etsu (Tradename SIFEL®).

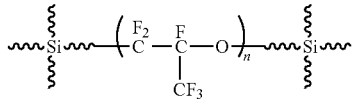

where n is a number of from about 0 to about 5000.

The release agent which is a liquid at a temperature of greater than 100° C. includes perfluoropolyether; polysiloxanes, for examples silicone oil; fluorinated polysiloxanes; fluorinated silanes; and polyhedral oligomeric silsesquioxanes (POSS).

Polyhedral oligomeric silsesquioxanes (POSS) with perfluoroalkyl substituents are suitable release agents and chemically similar to the cross-lined polymers described previously enabling dissolution and dispersion of the POSS within the cross-linked polymer.

Polysiloxanes, for examples silicone oil; fluorinated polysiloxanes; fluorinated silanes are well known release agents used in electrophotographic apparatuses.

Suitable perfluorpolyether for use as a release agent in described in U.S. Pat. No. 7,491,435, incorporated in its entirety herein. Examples of suitable release agents include those having the following skeletal Formulas I or II:

$$CF_3—(CF._2CF_2)_m—O—(R_1R_2O)—(R_3R_3O)_n—(R._3O)_p—(CF_2)_q—CF_3 \quad \text{(Formula I)}$$

wherein $R_1$ is $CF_2$, CF—$CF_3$ or —$NHR_4$; $R_2$ is $CF_2$, CF—$CF_3$, or —$NR_4R_5$; and $R_3$ is $CF_2$ or $CF_3$, $R_4$ is selected from the group consisting of hydrogen, alkyl group having from about 1 to about 18 carbon atoms or from about 1 to about 8 carbons or from about 1 to about 6 carbons or from about 1 to about 3 carbon atoms, arylalkyl group (with either the alkyl group or the aryl group being attached to the silicon atom) having from about 7 to about 18 carbon atoms or from about 7 to about 9 carbon atoms, mercapto, hydride or carbinol functional group; $R_5$ is selected from the group consisting of alkyl having from about 1 to about 20 carbons or from about 1 to about 10 carbons such as methyl, ethyl, butyl and the like, and a fluoroalkyl having from about 2 to about 10 carbons such as fluoromethyl, fluorobutyl, difluoroethyl, and the like; m is a number of 0 or 1; n is a number of from about 0 to about 500, or from about 200 to about 350; p is a number of from about 0 to about 100 or from about 50 to about 75; q is a number of 0 or 1; and p+n is a number of from about 100 to about 500 or from about 250 to about 425; and $$CF_3—(CF_2CF_2)_m—O—(R_2R_2O)_n—(R_2O)_p—(CF_2)_q—CF_2—R_1 \quad \text{(Formula II)}$$

wherein; $R_2$ is selected from the group consisting of $CF_2$ and CF—$CF_3$; m is a number of 0 or 1; n is a number of from about 0 to about 500, or from about 200 to about 350; p is a number of from about 0 to about 100 or from about 50 to about 75; q is a number of 0 or 1; and p+n is a number of from about 100 to about 500 or from about 250 to about 425. The alkyl groups above can include including linear, branched, cyclic, and unsaturated alkyl groups.

Additional perfluoropolyethers available from Shin Etsu include

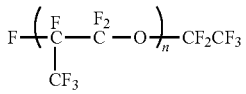

where n is a number of from about 0 to about 500.

In embodiments, the perfluoropolyether release agent has a viscosity of from about 75 to about 1,500 cS, or from about 100 to about 1,000 cS, when the release agent is used with toner.

The non-woven matrix of polymer fibers and having cross-linked polymer and release agent dispersed throughout has a thickness of from about 10 μm to about 400 μm, or from about 20 μm to about 300 μm, or from about 25 μm to about 200 μm.

The cross-linked fluoropolymer and release agent which is a liquid at a temperature of 100° C. are dispersed in a suitable solvent and coated onto the non-woven polymer fiber matrix. Typical techniques for coating such materials on the non-woven polymer fiber matrix include flow coating, liquid spray coating, dip coating, wire wound rod coating, fluidized bed coating, powder coating, electrostatic spraying, sonic spraying, blade coating, molding, laminating, and the like. After coating the cross-linked fluoropolymer and release agent dispersion is cured at a temperature of from about 255° C. to about 360° C. or from about 280° C. to about 330° C.

Examples of suitable solvents selected to form the cross-linked fluoropolymer and release agent composition include toluene, hexane, cyclohexane, heptane, tetrahydrofuran, methyl ethyl ketone, methyl isobutyl ketone, N,N'-dimethylformamide, N,N'-dimethylacetamide, N-methyl pyrrolidone (NMP), methylene chloride and the like and mixtures thereof where the solvent is selected, for example, in an amount of from about 70 weight percent to about 95 weight percent, and from 80 weight percent to about 90 weight percent based on the amounts in the coating mixture.

The release layer of the cross-linked polymer and the release agent dispersed in the non-woven polymer matrix has a surface energy of from about 8 mN/m to about 22 mN/m or from about 10 mN/m to about 20 mN/m or from about 12 mN/m to about 18 mN/m.

The surface layer is repaired or refurbished when heated a temperature of from about 100° C. to about 200° C., or in embodiments from about 120° C. to about 180° C., or from about 130° C. to about 160° C. The time the surface layer is held at the repair temperature is from about 1 minute to about 20 minutes, or from about 3 minutes to about 15 minute, or from about 5 minute to about 12 minutes. The repair occurs as the release agent migrates to the area of damage when heated. Because the release agent is a liquid and chemically similar to the cross-linked fluoropolymer, the release agent readily adheres to the cross-lined fluoropolymer.

Specific embodiments will now be described in detail. These examples are intended to be illustrative, and not limited to the materials, conditions, or process parameters set forth in these embodiments. All parts are percentages by solid weight unless otherwise indicated.

EXAMPLES

A fuser topcoat was fabricated by applying the polyimide fibers onto an intermediate layer of silicone bonded to metal substrate layer by electrospinning process. After the non-woven polyimide fibers were applied, a composition of cross-linked perfluorpolyether (SIFEL®) mixed with liquid perfluoropolyether was flow-coating onto the polyimide fibers. The mixture of cross-linked perfluorpolyether and liquid perfluorpolyether was cured through heat-treatment at about 150° C. to about 200° C. The cured polyfluoropolyether was dispersed throughout the non-woven polyimide network. After curing the rolls were tested in a fusing fixture and compared to the current production fuser roll (Xerox DC700). This fusing fixture allows the rolls to be easily changed tested under a wide variety of controlled conditions that simulate those conditions found in production printers. A process speed of 220 mm/s was used and the temperature to fuse DC700 toner onto Color Xpressions Select, 90 gsm, uncoated paper (P/N 3R11540) was varied from 130° C. to 210° C. The self-release topcoat (Roll #1) has a higher hot offset temperature (no hot offset seen up to 210° C. versus hot offset to the roll at 205° C.) than a composition containing no liquid perfluoropolyether (Roll #2) indicated by fusing tests results (Table 1). For reference the fuser roll used in the DC7000 printer hot offset at 205° C. The hot offset temperature is an upper limit failure mode where toner sticks to the fuser roll and gets printed back onto subsequent pages. Higher hot offset temperatures are desirable.

Another failure mode to evaluate fusing performance of rolls is cold offset, a lower limit failure where temperature of the fuser roll is not high enough to fuse toner onto the paper (adhesion to the sheet is not sufficient). Low cold offset temperatures are desirable. Roll #1 has a higher cold offset temperature when compared to Roll #2 and the slightly higher cold offset temperature can be addressed by improving stiffness of the SIFEL material (e.g., addition of fillers). In addition to failure modes listed previously, how print samples look after being fused is another metric for evaluation. Peak gloss (gu=gloss units measured using a BYK Gardner 75 Degree gloss meter) of prints samples fused by the rolls show Roll #1 and #2 are lower in gloss when compared to DC700 roll. The difference in gloss is due the surface texture of rolls and can be improved by optimizing coating conditions.

TABLE 1

| Metric | DC700 | Roll #1 Cross-linked PFPE/liquid PFPE | Roll #2 Cross-Linked PFPE |
|---|---|---|---|
| Cold Offset (° C.) | 132 | 145 | 131 |
| Peak Gloss (gu) | 69 | 65 | 65 |
| Hot Offset (° C.) | 205 | >210 | 205 |

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A fuser member comprising:

a substrate layer; and a surface layer disposed on the substrate layer comprising a non-woven polymer fiber web structure having dispersed throughout a cross-linked fluoropolymer and a release agent wherein the release agent is a liquid at temperatures greater than 100° C.

2. The fuser member of claim 1, wherein the cross-linked fluoropolymer is selected from the group consisting of: copolymers of two of vinylidenefluoride, hexafluoropropylene, and tetrafluoroethylene; terpolymers of vinylidenefluoride, hexafluoropropylene, and tetrafluoroethylene; tetrapolymers of vinylidenefluoride, hexafluoropropylene, tetrafluoroethylene and a cure site monomer; and perfluoropolyether.

3. The fuser member of claim 1, wherein the cross-linked fluoropolymer is from about 10 weight percent to about 95 weight percent of the surface layer.

4. The fuser member of claim 1, wherein the release agent is selected from the group consisting of: perfluoropolyethers; polysiloxanes; fluorinated silanes; and polyhedral oligomeric silsesquioxanes.

5. The fuser member of claim 1, wherein the release agent is from about 1 weight percent to about 50 weight percent of the surface layer.

6. The fuser member of claim 1, wherein the surface layer can be repaired when heated to a temperature of greater than 100° C. for a time of about 1 minute.

7. The fuser member of claim 1, wherein the non-woven polymer fiber web structure comprises a polymer selected from the group consisting of a polyamide, polyester, polyimide, polycarbonate, polyurethane, polyether, polyoxadazole, polybenzimidazole, polyacrylonitrile, polycaprolactone, polyethylene, polypropylenes, acrylonitrile butadiene styrene (ABS), polybutadiene, polystyrene, polyhedral oligomeric silsesquioxane (POSS), poly(vinyl alcohol), poly(ethylene oxide), polylactide, poly(caprolactone), poly(ether imide), poly(ether urethane), poly(arylene ether), poly (arylene ether ketone), poly(ester urethane), cellulose acetate, poly(vinyl acetate), poly(acrylic acid), polyacrylamide, polyvinylpyrrolidone, hydroxypropylcellulose, poly (vinyl butyral), poly(alkyl acrylate), poly(alkyl methacrylate), polyhydroxybutyrate, fluoropolymer, cellulose, chitosan, gelatin, protein, and mixtures thereof.

8. The fuser member of claim 1, wherein the non-woven polymer fibers have a diameter of from about 5 nm to about 50 μm.

9. The fuser member of claim 1, wherein the surface layer has a thickness of from about 10 microns to about 400 microns.

10. The fuser member of claim 1, further comprising an intermediate layer disposed between the surface layer and the substrate, wherein the intermediate layer comprises an elastomer.

11. The fuser member of claim 1, wherein polymer fibers of the non-woven polymer fiber web structure comprise a fluorinated polyimide core and a fluoropolymer sheath.

12. A fuser member comprising:

a substrate;

an intermediate layer disposed on the substrate; and a surface layer disposed on the substrate comprising a non-woven polymer fiber web structure having dispersed throughout a cross-linked fluoropolymer and a release agent, wherein the cross-linked fluoropolymer is from about 10 weight percent to about 95 weight percent of the surface layer, wherein the release agent is a liquid at temperatures greater than 100° C. wherein the release agent is from about 1 weight percent to about 50 weight percent of the surface layer.

13. The fuser member of claim 12, wherein the cross-linked fluoropolymer is selected from the group consisting of: copolymers of two of vinylidenefluoride, hexafluoropropylene, and tetrafluoroethylene; terpolymers of vinylidenefluoride, hexafluoropropylene, and tetrafluoroethylene; tetrapolymers of vinylidenefluoride, hexafluoropropylene, tetrafluoroethylene and a cure site monomer; and perfluoropolyether.

14. The fuser member of claim 12, wherein the release agent is selected from the group consisting of: perfluoropolyethers; polysiloxanes; fluorinated silanes; and polyhedral oligomeric silsesquioxanes.

15. The fuser member of claim 12, wherein the surface layer can be repaired when heated to a temperature of greater than 100° C. for a time of about 1 minute.

16. The fuser member of claim 12, wherein the non-woven polymer fiber web structure comprises a polymer selected from the group consisting of a polyamide, polyester, polyimide, polycarbonate, polyurethane, polyether, polyoxadazole, polybenzimidazole, polyacrylonitrile, polycaprolactone, polyethylene, polypropylenes, acrylonitrile butadiene styrene (ABS), polybutadiene, polystyrene, polyhedral oligomeric silsesquioxane (POSS), poly(vinyl alcohol), poly(ethylene oxide), polylactide, poly(caprolactone), poly(ether imide), poly(ether urethane), poly(arylene ether), poly (arylene ether ketone), poly(ester urethane), cellulose acetate, poly(vinyl acetate), poly(acrylic acid), polyacrylamide, polyvinylpyrrolidone, hydroxypropylcellulose, poly (vinyl butyral), poly(alkyl acrylate), poly(alkyl methacrylate), polyhydroxybutyrate, fluoropolymer, cellulose, chitosan, gelatin, protein, and mixtures thereof.

17. The fuser member of claim 12, wherein the non-woven polymer fibers of the web structure have a diameter of from about 5 nm to about 50 μm.

18. A fuser member comprising:

a substrate;

a silicone layer disposed on the substrate; and a surface layer disposed on the silicone layer, the surface layer comprising a non-woven polyimide fiber web structure having dispersed throughout a cross-linked perfluoropolyether and a perfluoropolyether release agent that is a liquid at temperatures greater than 100° C., wherein the polyimide fibers have a diameter of from about 5 nm to about 50 μm.

19. The fuser member of claim 18, wherein the polyimide fibers comprise:

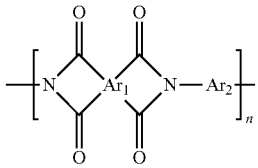

wherein $Ar_1$ and $Ar_2$ independently represent an aromatic group of from 4 carbon atoms to 100 carbon atoms; and at least one of $Ar_1$ and $Ar_2$ further contains a fluoropendant group wherein n is from 30 to 500.

20. The fuser member of claim 18, wherein the polyimide fibers further comprise a fluoropolymer sheath.

* * * * *